US009901162B1

(12) United States Patent
Chang

(10) Patent No.: US 9,901,162 B1
(45) Date of Patent: Feb. 27, 2018

(54) MODULAR BAG

(71) Applicant: Teng-Yao Chang, Taichung (TW)

(72) Inventor: Teng-Yao Chang, Taichung (TW)

( * ) Notice: Subject to any disclaimer, the term of this patent is extended or adjusted under 35 U.S.C. 154(b) by 37 days.

(21) Appl. No.: 15/249,884

(22) Filed: Aug. 29, 2016

(51) Int. Cl.
*A45F 3/04* (2006.01)

(52) U.S. Cl.
CPC ..... *A45F 3/047* (2013.01); *A45F 3/04* (2013.01)

(58) Field of Classification Search
CPC ..... A45F 3/04; A45F 3/042; A45F 2003/045; A45F 3/047; A45F 3/06
USPC ..... 224/581–583, 605, 609, 623, 627, 224/637–659
See application file for complete search history.

(56) References Cited

U.S. PATENT DOCUMENTS 4,793,534 A * 12/1988 Berry ..... A45F 3/02 224/223
5,497,922 A * 3/1996 Tate ..... A45F 3/04 224/160
6,619,519 B1 * 9/2003 Nix ..... A45C 7/0086 224/153
2006/0138188 A1 * 6/2006 Kramer ..... A45F 3/08 224/581
2008/0029565 A1 * 2/2008 Enriquez ..... A45F 3/04 224/647
2009/0020580 A1 * 1/2009 Tate ..... A45F 3/047 224/637
2009/0095784 A1 * 4/2009 Enriquez ..... A45F 3/00 224/650

* cited by examiner

*Primary Examiner* — Nathan J Newhouse
*Assistant Examiner* — Scott McNurlen
(74) *Attorney, Agent, or Firm* — Tracy M. Helms; Apex Juris, pllc.

(57) ABSTRACT

A modular bag includes first and second bags, pairs of first and second straps, first to four fasteners, wherein the first straps are provided on the first bag, and each includes a shoulder band, an adjustment ring, and an adjustment band, the shoulder band is connected to an upper portion of the first bag, the adjustment ring is connected to the shoulder band. The adjustment band is connected to a bottom of the first bag, and passes through the adjustment ring, which forms a free section, the first fasteners are provided on the shoulder bands, the second fasteners are provided on the free sections, the second straps are connected to an upper portion of the second bag, the third fasteners are respectively provided on the second straps, and detachably fastened to the first fasteners, and the fourth fasteners are respectively provided on the second bag and detachably fastened to the second fasteners.

7 Claims, 5 Drawing Sheets

MODULAR BAG

BACKGROUND OF THE INVENTION

1. Technical Field

The present invention relates generally to a bag, and more particularly to a modular backpack.

2. Description of Related Art

Backpacks are commonly used in situations such as going on a picnic, commuting, traveling, or other outdoor activities. Since using a backpack is a convenient way to carry things around without excessively hindering the mobility of the user, backpacks are also widely used in military activities.

However, a typical and conventional backpack is merely one single pack to be carried on the back. In other words, while in use, most of the weight of a backpack would be exerted on the user's back, which may cause muscle strains or even worse injuries if the user carries his backpack around for a long period of time. In addition, it's always annoying to take out of a backpack small objects such as lipsticks, eye drops, or water bottles. A carrier usually has to put down his backpack even if just to reach one item contained in the backpack. Therefore, the conventional backpacks still have room for improvements.

BRIEF SUMMARY OF THE INVENTION

In view of the above, the primary objective of the present invention is to provide a modular bag which is more convenient, and the weight thereof would be exerted on one's body in balance.

The present invention provides a modular bag, comprising a first bag, a pair of first straps, two first fasteners, two second fasteners, a second bag, a pair of second straps, two third fasteners, and two fourth fasteners. The first bag includes a first containing space, which is adapted to receive objects. The pair of first straps are provided on the first bag side by side, wherein each of the first straps includes a shoulder band, an adjustment ring, and an adjustment band. An end of the shoulder band is connected to an upper portion of the first bag. The adjustment ring is connected to another end of the shoulder band. An end of the adjustment band is connected to a bottom of the first bag, and another end thereof passes through the adjustment ring, wherein a portion of the adjustment band which passes through the corresponding adjustment ring forms a free section. The first fasteners are respectively provided on the shoulder bands. The second fasteners are respectively provided on the free sections of the adjustment bands. The second bag has a second containing space, which is adapted to receive objects. An end of each of the pair of second straps is connected to an upper portion of the second bag. The third fasteners are respectively provided on the pair of second straps, wherein each of the third fasteners is detachably fastened to one of the first fasteners. The fourth fasteners are respectively provided on two lateral sides of the second bag, wherein each of the fourth fasteners is detachably fastened to one of the second fasteners.

Whereby, through the fasteners, the first bag and the second bag can be combined to form a modular bag, and users can thus carry said two bags in front of the body and on the back respectively, such that the weight of the modular bag could be exerted on users' body in balance. Furthermore, small objects which are often used can be received in the bag in front of the body to be easily taken out.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
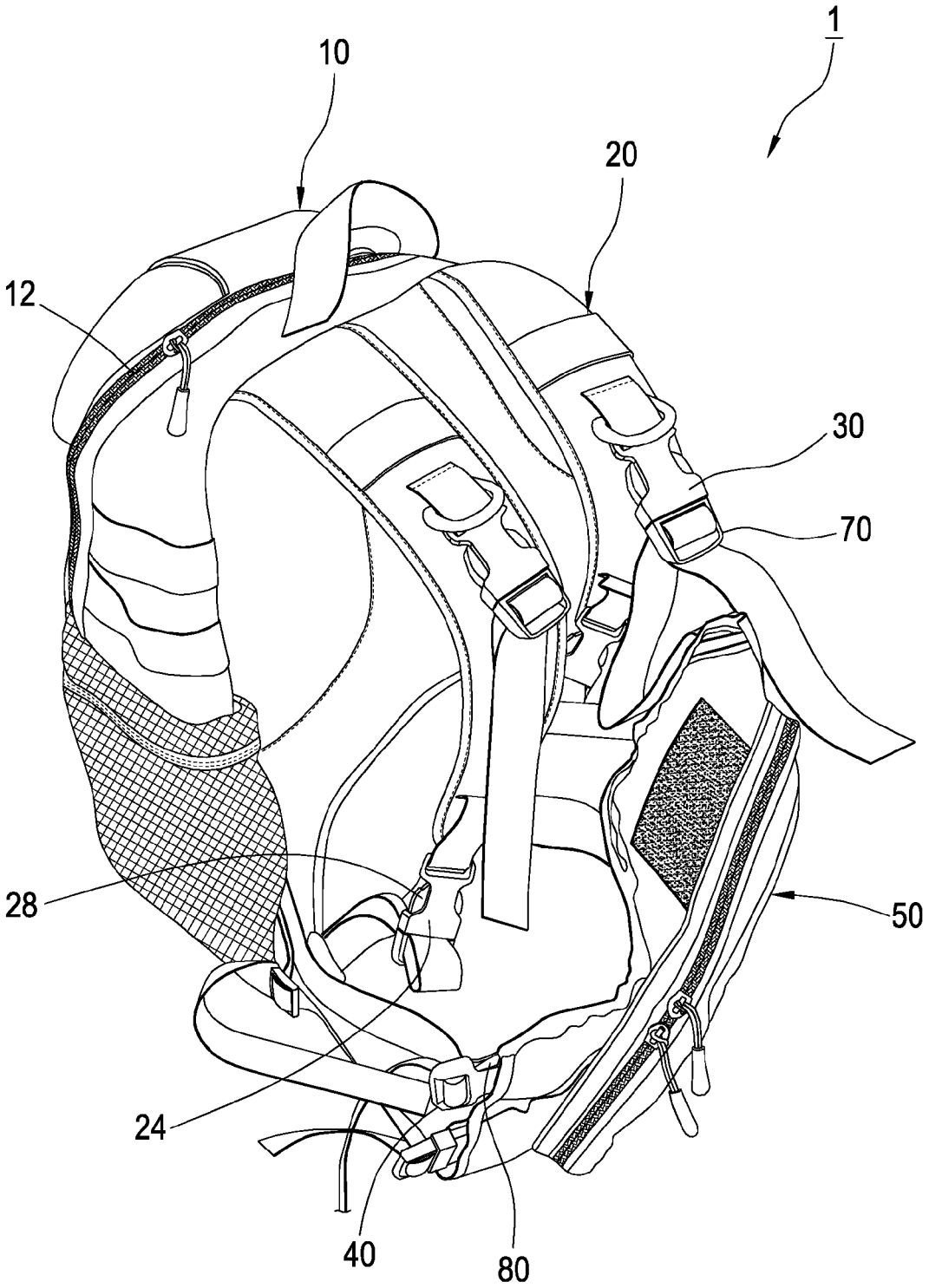
FIG. 1 is a perspective view of a preferred embodiment of the present invention.

As shown in FIG. 1 to FIG. 4, the modular bag 1 includes a first bag 10, a pair of first straps 20, two first fasteners 30, two second fasteners 40, a second bag 50, a pair of second straps 60, two third fasteners 70, and two fourth fasteners 80.

The first bag 10 has a first containing space adapted to receive objects, and an opening thereon communicating with the first containing space. In the preferred embodiment, a sealing structure that is adapted to close the opening is a zipper 12. Moreover, two restriction rings 14 are respectively provided on two lateral sides in a lower portion of the first bag 10. However, in another embodiment, the first bag 10 may have other containing spaces aside from the first containing space. In addition, the sealing structures in other embodiments could be hook and loop fasteners, binding belts, buckles, or buttons, instead of the zipper.

The two first straps 20 are provided on the first bag 10 side by side, wherein each of the first straps 20 includes a shoulder band 22, a seventh fastener 24, an adjustment band 26, and an eighth fastener 28 which has an adjustment ring 27. Because the structures of the two first straps 20 are the same, and the two first straps 20 are symmetrically arranged, the structure of one of the first straps 20 is specified as follows.

An end of the shoulder band 22 is connected to a peripheral edge of an upper portion of the first bag 10, while another end of the shoulder band 22 is connected to the seventh fastener 24. An end of the adjustment band 26 is connected to a bottom of the first bag 10, and another end thereof passes through the adjustment ring 27, wherein a portion of the adjustment band 26 which passes through the corresponding adjustment ring 27 forms a free section 261. Preferably, said free section 261 could further pass through the restriction ring 14. The eighth fasteners 28 is detachably fastened to the seventh fasteners 24, wherein in the preferred embodiment, the seventh fasteners 24 and the eighth fasteners 28 are hook and loop fasteners, i.e., the seventh fasteners 24 are loop fasteners, and the eighth fasteners 28 are hook fasteners. However, in another embodiment, the seventh fasteners 24 could be hook fasteners, while the eighth fasteners 28 could be corresponding loop fasteners. Accordingly, the shoulder band 22 and the adjustment band 26 can be connected to form a cyclic structure, the first strap 20, by the seventh fasteners 24 and the eighth fasteners 28, to goes over user's shoulders.

Additionally, the adjustment ring 27 is adapted to adjust a length of the first strap 20, and to provide a friction which resists the sliding and moving of the adjustment band 26. In this sense, if the free section of the adjustment band 26 which passes through the adjustment ring 27 is longer, the length of the shoulder band 22 and the adjustment band 26 which form the cyclic structure is shorter. Conversely, if the free section of the adjustment band 26 which passes through the adjustment ring 27 is shorter, the length of the shoulder band 22 and the adjustment band 26 which form the cyclic structure is longer. In such way, users can adjust the length of the two first straps 20 as required.

Figure 2:
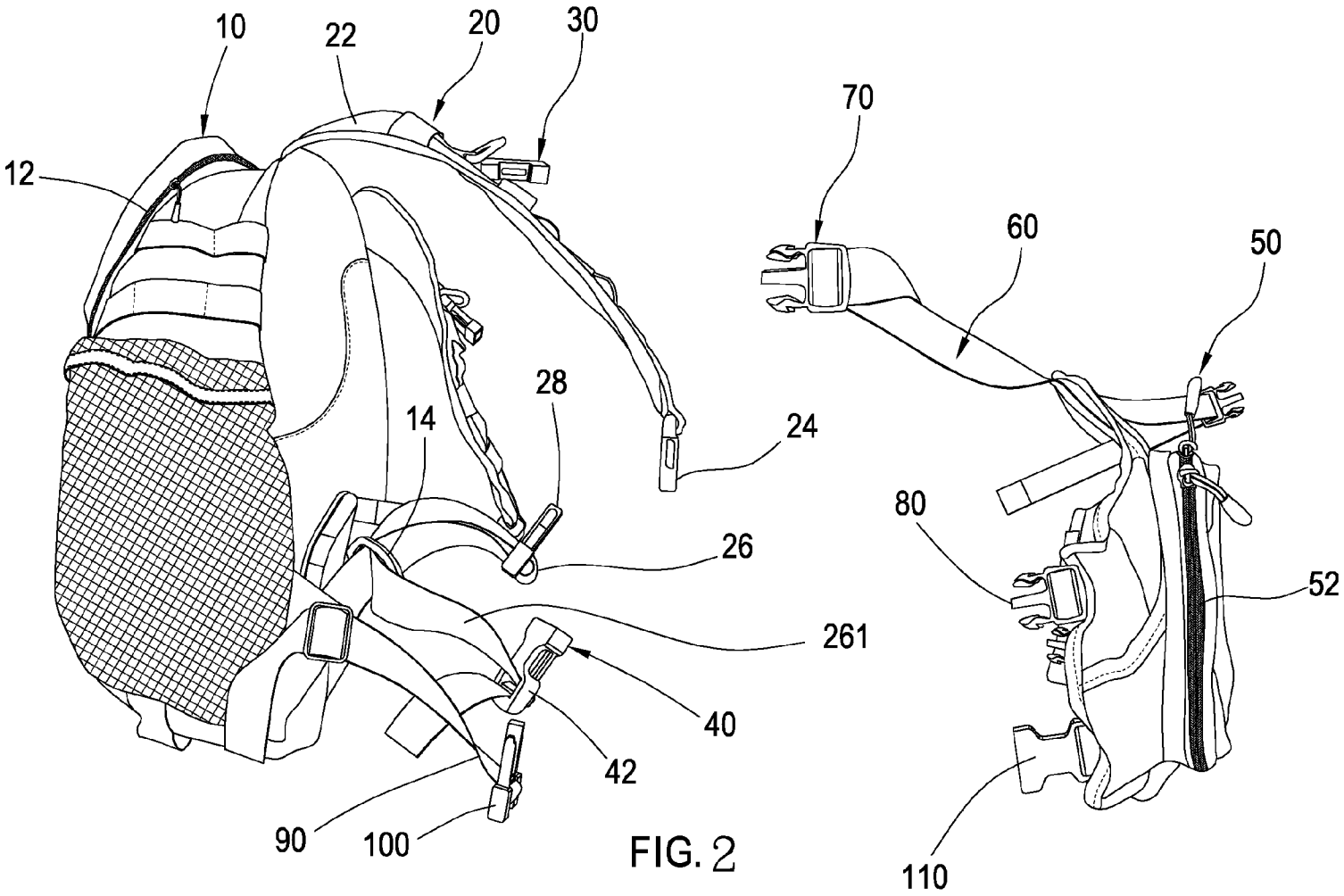
FIG. 2 is an exploded view of the preferred embodiment.
Figure 3:
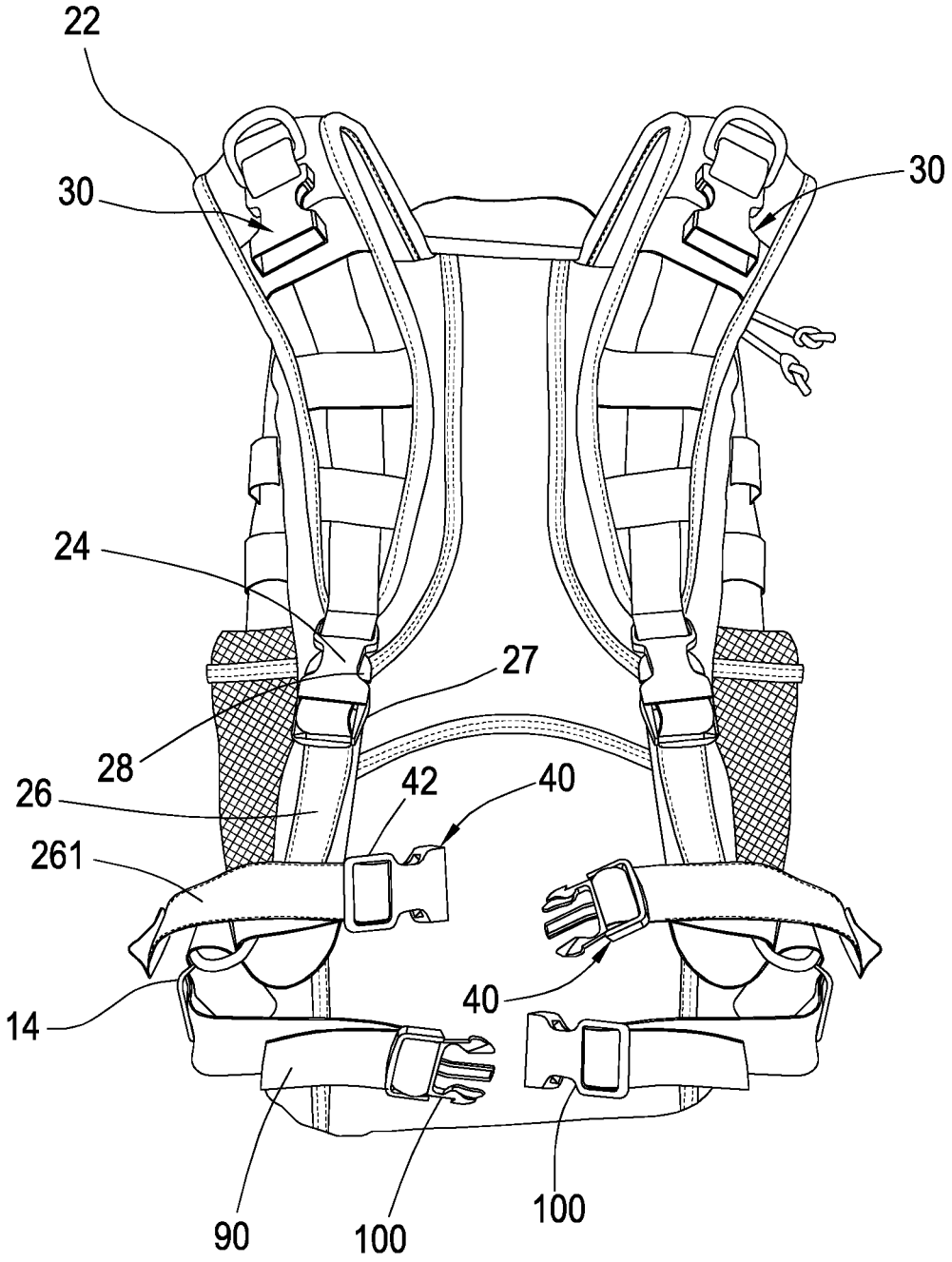
FIG. 3 is a schematic diagram of the preferred embodiment, showing a rear view of the first bag.
Figure 4:
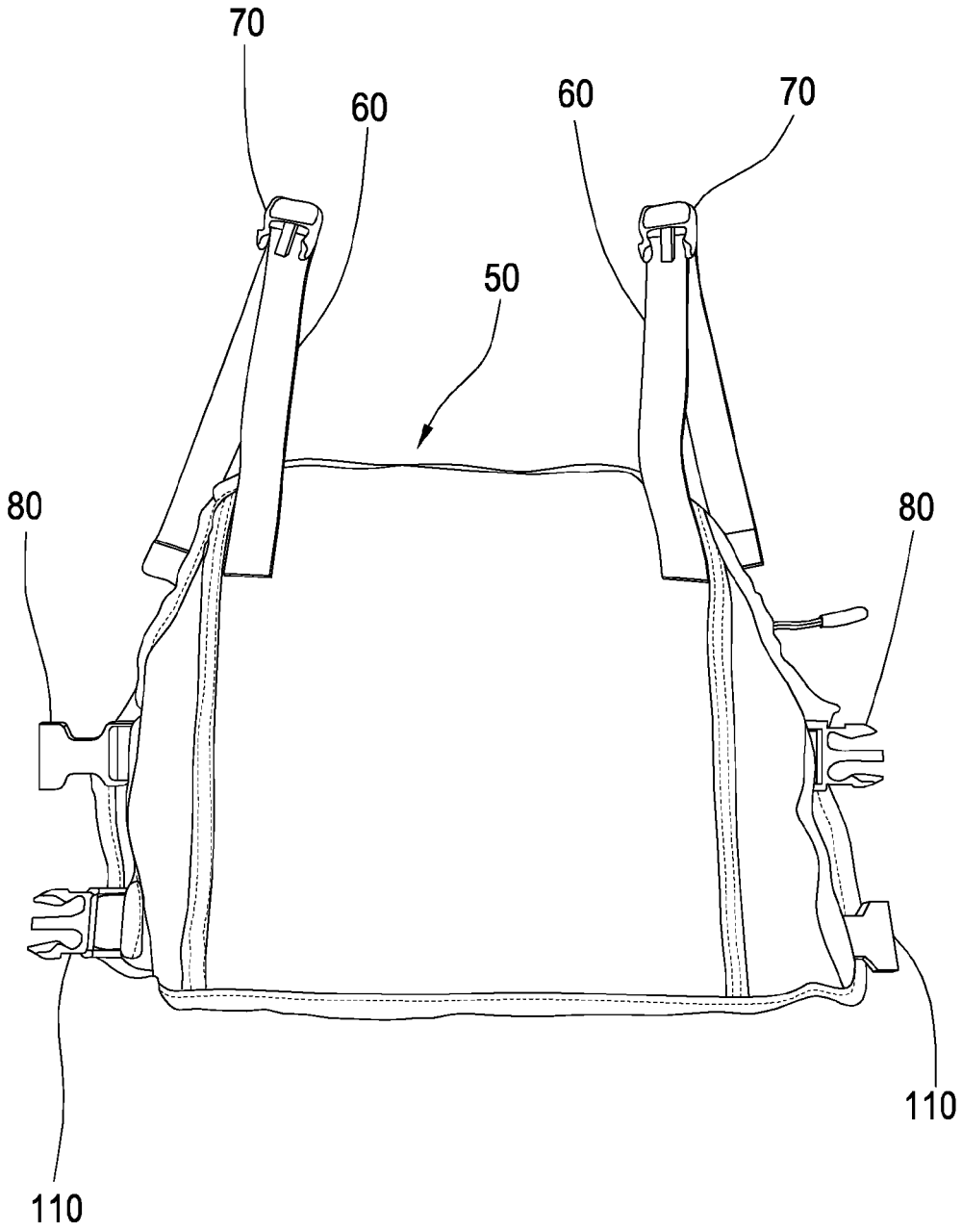
FIG. 4 is a schematic diagram of the preferred embodiment, showing a rear view of the second bag.

In addition, if the seventh fasteners 24 and the eighth fasteners 28 are detached, the shoulder band 22 and the adjustment band 26 would be separated as shown in FIG. 2, and the first bag 10 can thus be put down from users.

The two first fasteners 30 are respectively provided on the two shoulder bands 22; preferably, the first fasteners 30 are provided close to the first bag 10 and far from the adjustment rings 27. In this sense, when a user carries the modular bag 1, the point of application of a downward component of force generated by the weight of the modular bag 1 would lie on the shoulder band 22 and the first fastener 30 right above user's shoulder. Accordingly, the weight of the modular bag 1 would be exerted on user's body in balance. In the preferred embodiment, the two first fasteners 30 are loop fasteners.

The two second fasteners 40 are respectively provided on the free sections 261 of the two adjustment bands 26. In the preferred embodiment, one of the second fasteners 40 is a loop fastener, and the other is a hook fastener. Preferably, the two second fasteners 40 is adjustable provided on the free sections 261. For being adjustable, the second fasteners 40 includes an adjustment ring 42, and the free section 261 of the adjustment band 26 passes through the adjustment ring 42, wherein the adjustment ring 42 is adapted to provide a friction which resists the sliding and moving of the adjustment band 26. Therefore, the second fastener 40 can be positioned at any positions of the free section 261 as desired. However, the method of adjusting the second fasteners 40 is not limited to using the adjustment ring 42.

The second bag 50 has a second containing space adapted to receive objects, and an opening thereon communicating with the second containing space. In the preferred embodiment, a sealing structure that is adapted to close the opening is a zipper 52.

An end of each of the second straps 60 is provided on an upper portion of the second bag 50, and the two third fasteners 70 are respectively connected to the two second straps 60. The third fasteners 70 are detachably fastened to the first fasteners 30, wherein in the preferred embodiment, the third fasteners 70 are hook fasteners, while the first fasteners 30 are corresponding loop fasteners.

Preferably, the two third fasteners 70 are adjustably provided on the two second straps 60. Similar to the second fastener 40, the third fastener 70 includes an adjustment ring to be passed through by the second strap 60. However, the method of adjusting the third fasteners 70 is not limited to using said adjustment ring.

The two fourth fasteners 80 are respectively provided on two lateral sides of the second bag 50, wherein each of the fourth fasteners 80 is detachably fastened to one of the second fasteners 40. In the preferred embodiment, one of the fourth fasteners 80 is a loop fastener, which is adapted to fasten to one of the second fasteners 40 which is a hook fastener. The other fourth fasteners 80 is a hook fastener, which is adapted to fasten to the other second fasteners 40 which is a loop fastener.

In addition, for improving the connection stability of the first bag 10 and the second bag 50, the modular bag 1 further includes a pair of belts 90, two fifth fasteners 100, and two sixth fasteners 110.

An end of each of the belts 90 is connected to one of two lateral sides of the first bag 10, and each of the fifth fasteners 100 is provided on one of the pair of belts 90. Preferably, the fifth fasteners 100 are adjustably provided on the belts 90, in order to correspond with user's waistline, and to make the user be comfortable. In the preferred embodiment, the two fifth fasteners 100 are hook and loop fasteners. However, in another embodiment, the fifth fasteners 100 are not limited to hook and loop fasteners.

The two sixth fasteners 110 are respectively provided on the lateral sides of the second bag 50, and each of the sixth fasteners 110 is detachably fastened to one of the fifth fasteners 100. In the preferred embodiment, one of the sixth fasteners 110 is a loop fastener, which is adapted to fasten to one of the fifth fasteners 100 which is a hook fastener. The other sixth fasteners 110 is a hook fastener, which is adapted to fasten to the other fifth fasteners 100 which is a loop fastener.

Figure 5:
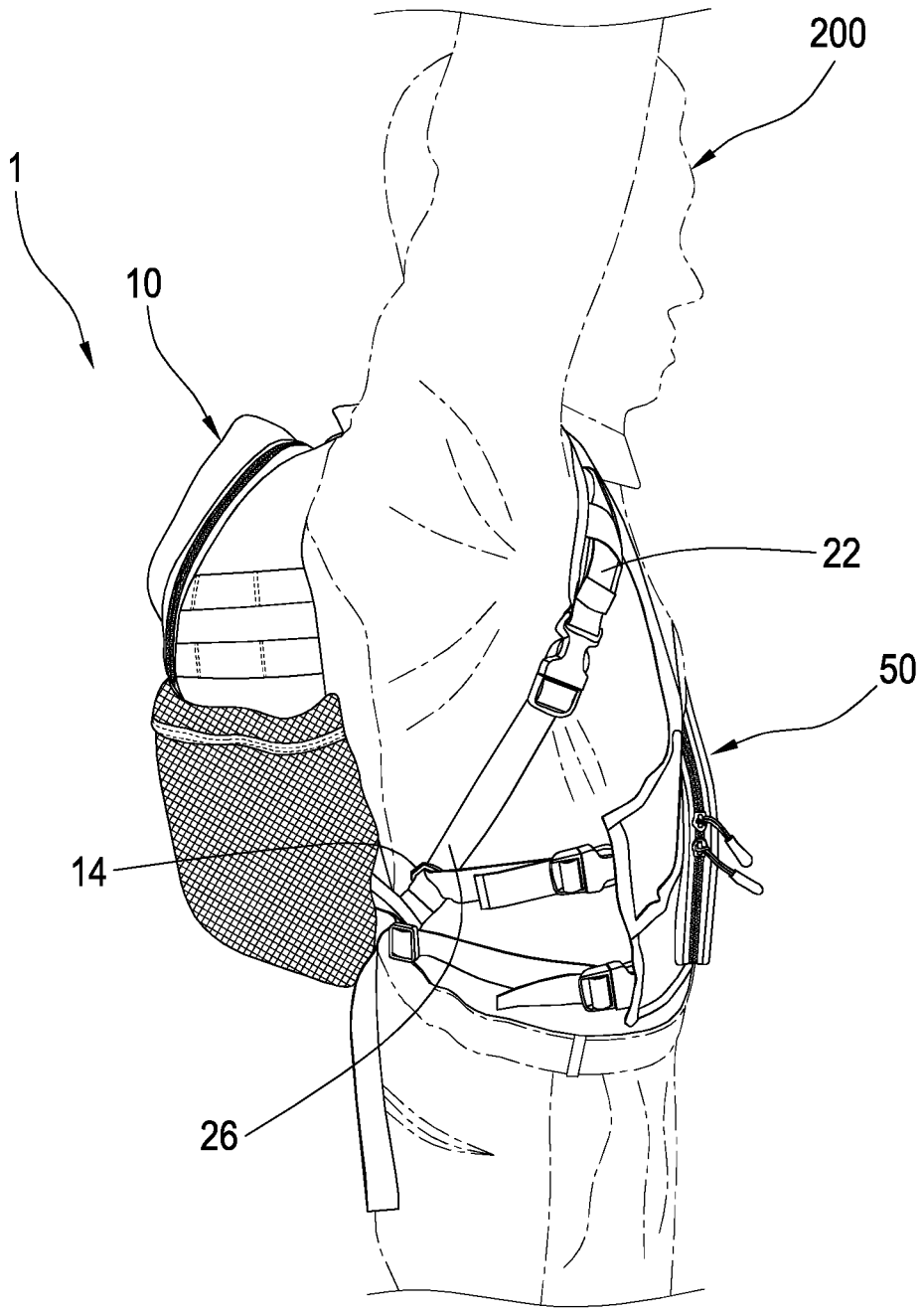
FIG. 5 is a schematic diagram of the preferred embodiment, showing the modular bag carried by a user.

As illustrated in FIG. 5, the modular bag 1 is carried by a user 200, wherein the user 200 can carry the first bag 10 on the back, and the second bag 50 in front of the body. Whereby, objects received in the second containing space of the second bag 50 are easily taken out. Furthermore, the weight of the modular bag 1 could be exerted on the user's body in balance in order to prevent muscle strains.

In addition, with the design of the second fasteners 40 connected to the adjustment band 26, the excess or unused free section 261 are used, and the cost of the modular bag 1 would be reduced.

Moreover, as shown in FIG. 5, if the adjustment band 26 passes through the restriction ring 14, the shoulder band 22 would be stably in contact with the body of the user 200. Additionally, the second bag 50 would be tensioned by the lateral forces, and also be firmly in contact with the body of the user 200.

Furthermore, in military use, the second bag 50 in front of the user 200 could receive a metal plate, a ceramic plate, a fiberboard, or other composite materials which are puncture-resistant and may even be made bulletproof, in order to ensure the safety of the user 200. However, in another embodiment, the first bag 10 can also receive the aforementioned materials.

It must be pointed out that the embodiments described above are only some preferred embodiments of the present invention. For example, the corresponding first to eighth fasteners are not limited to hook and loop fasteners, and can be other detachably connectors, buckles, or buttons. All equivalent structures which employ the concepts disclosed in this specification and the appended claims should fall within the scope of the present invention.

What is claimed is:

1. A modular bag, comprising:

a first bag having a first containing space, which is adapted to receive objects;

a pair of first straps provided on the first bag side by side, wherein each of the pair of first straps comprises a shoulder band, an adjustment ring, and an adjustment band; an end of the shoulder band is connected to an upper portion of the first bag; the adjustment ring is connected to another end of the shoulder band; an end of the adjustment band is connected to a bottom of the first bag, and another end thereof passes through the adjustment ring, wherein a portion of the adjustment band which passes through the corresponding adjustment ring forms a free section;

two first fasteners which are respectively provided on the shoulder bands;

two second fasteners which are respectively provided on the free sections of the adjustment bands;

a second bag having a second containing space, which is adapted to receive objects;

a pair of second straps, wherein an end of each of the pair of second straps is connected to an upper portion of the second bag;

two third fasteners which are respectively provided on the pair of second straps, wherein each of the third fasteners is detachably fastened to one of the first fasteners; and two fourth fasteners which are respectively provided on two lateral sides of the second bag, wherein each of the fourth fasteners is detachably fastened to one of the second fasteners.

2. The modular bag of claim 1, wherein the first bag comprises two restriction rings respectively provided on two lateral sides thereof; the free section of each of the adjustment bands passes through one of the restriction rings.

3. The modular bag of claim 1, further comprising a pair of belts, two fifth fasteners, and two sixth fasteners, wherein an end of each of the belts is connected to one of two lateral sides of the first bag, and each of the fifth fasteners is provided on one of the pair of belts; the sixth fasteners are respectively provided on the lateral sides of the second bag, and each of the sixth fasteners are detachably fastened to one of the fifth fasteners.

4. The modular bag of claim 3, wherein each of the sixth fasteners is provided below one of the fourth fasteners.

5. The modular bag of claim 1, wherein the another end of each of the shoulder bands is connected to a seventh fastener; the adjustment band is connected to an eighth fastener, which is detachably fastened to the seventh fastener, wherein each of the eighth fasteners comprises one of the adjustment rings.

6. The modular bag of claim 1, wherein the adjustment rings are adapted to adjust a length of the first straps.

7. The modular bag of claim 1, wherein each of the first fasteners is provided closer to the first bag and far from than the corresponding adjustment ring.

* * * * *